US007325336B2

(12) United States Patent
Yamashita et al.

(10) Patent No.: US 7,325,336 B2
(45) Date of Patent: Feb. 5, 2008

(54) WRESTLING SHOE WITH SEPARATED OUTER SOLES

(75) Inventors: Yoshio Yamashita, Kobe (JP); Hidenori Yamashita, Kobe (JP); Yasuhiro Morikawa, Kobe (JP)

(73) Assignee: ASICS Corp., Kobe (JP)

( * ) Notice: Subject to any disclaimer, the term of this patent is extended or adjusted under 35 U.S.C. 154(b) by 422 days.

(21) Appl. No.: 10/990,064

(22) Filed: Nov. 16, 2004

(65) Prior Publication Data

US 2005/0108901 A1 May 26, 2005

(30) Foreign Application Priority Data

Nov. 26, 2003 (JP) ..... 2003-395248

(51) Int. Cl.
*A43B 5/00* (2006.01)

(52) U.S. Cl. ..... 36/102; 36/31; 36/114; 36/103; 36/107

(58) Field of Classification Search ..... 36/113, 36/114, 102, 103, 97, 107, 25 R, 31, 91, 28
See application file for complete search history.

(56) References Cited

U.S. PATENT DOCUMENTS

| | | | | |
|---|---|---|---|---|
| 2,926,433 | A | 3/1960 | Kramer | |
| 3,363,342 | A | 1/1968 | Stohr | |
| 4,519,148 | A * | 5/1985 | Sisco | 36/91 |
| 4,542,598 | A | 9/1985 | Misevich et al. | |
| 4,924,606 | A | 5/1990 | Montgomery et al. | |
| 5,682,685 | A * | 11/1997 | Terlizzi | 36/8.3 |
| D387,864 | S | 12/1997 | Hatfield | |
| D412,237 | S | 7/1999 | Hatfield | |
| 5,956,868 | A | 9/1999 | Stevens et al. | |
| 6,076,284 | A | 6/2000 | Terlizzi | |
| 6,389,713 | B1 | 5/2002 | Kita | |
| D465,644 | S | 11/2002 | Belley et al. | |
| 6,634,121 | B2 | 10/2003 | Sordi | |
| 6,662,469 | B2 | 12/2003 | Belley et al. | |

(Continued)

FOREIGN PATENT DOCUMENTS

| | | |
|---|---|---|
| JP | 44-27742 | 11/1969 |
| JP | 08-117001 | 5/1996 |

*Primary Examiner*—Marie Patterson
(74) *Attorney, Agent, or Firm*—Michael E. Zall

(57) ABSTRACT

The wrestling shoe according to the present invention comprises outer soles 1F and 1B separated forward and rearward on the side of a grounding surface of the shoe. The fore and rear outer soles 1F and 1B essentially protrude downward further than an outer skin 3, thereby to support the foot in a fore foot part and a rear foot part, respectively, when landing on the ground. The fore and rear outer soles 1F and 1B are made of an outer sole material of rubber and/or resin. The outer skin 3 is formed of a laminated body where an outer surface layer 30 and a cushion layer 31 are laminated. The outer surface layer 30 is exposed in a mid foot part M and made of substantially flexible sheet-like material, and the cushion layer 31 is laminated on the inner side of the outer surface layer 30 and made of substantially flexible rubber foam or resin foam. The outer skin 3 is formed so that a bottom portion 32 and medial and lateral roll-up portions 33 that roll up from the bottom portion 32 along an upper 2 are integrally formed.

5 Claims, 4 Drawing Sheets

U.S. PATENT DOCUMENTS

| | | | | |
|---|---|---|---|---|
| 6,675,499 | B2 | 1/2004 | Ellis | |
| 6,684,532 | B2 | 2/2004 | Greene et al. | |
| 6,763,615 | B2 * | 7/2004 | Mitsui et al. | 36/91 |
| 6,857,203 | B2 * | 2/2005 | Minden | 36/8.3 |
| 2001/0005947 | A1 | 7/2001 | Sordi | |
| 2002/0017036 | A1 * | 2/2002 | Berger et al. | 36/3 B |
| 2002/0078591 | A1 | 6/2002 | Morrone | |
| 2002/0078601 | A1 | 6/2002 | Alfond et al. | |
| 2003/0005600 | A1 * | 1/2003 | Kita | 36/76 R |
| 2003/0079374 | A1 | 5/2003 | Belley et al. | |
| 2003/0121176 | A1 | 7/2003 | Baruck | |
| 2003/0192204 | A1 | 10/2003 | Miller et al. | |
| 2004/0123495 | A1 | 7/2004 | Greene et al. | |

* cited by examiner

WRESTLING SHOE WITH SEPARATED OUTER SOLES

CROSS-REFERENCE TO RELATED APPLICATIONS

The present application claims the benefit of patent application number 2003-395248, filed in Japan on Nov. 26, 2003, the subject matter of which is hereby incorporated herein by reference.

BACKGROUND OF THE INVENTION

1. Field of the Invention

The present invention relates to a wrestling shoe with separated outer soles.

2. Description of the Related Art

The following documents disclose shoes with separated outer soles. However, these shoes are not wrestling shoes.

In the shoe disclosed in Japanese Utility Model (examined) No. 44-27742, rubber soleplates are adhered separately to only treading parts in front and at the back of the arch of the foot, respectively, so that the arch is easy to bend. However, this shoe is inferior in supporting function and further a wearer is likely to feel a shock when a load is applied from below the arch.

FIG. 4(*a*) is a perspective view of the shoe disclosed in Japanese Patent Laid-Open No. 8-117001 and FIG. 4(*b*) is a bottom view thereof.

In FIG. 4(*a*) and FIG. 4(*b*), an upper 102 is extended to form a mid-foot section 103 between the thick and durable outer soles 100 and 101. The mid-foot section 103 is provided with a non-stretchable reinforcing member 104, which is formed in a belt-like shape, for preventing slack in the material of the mid-foot section 103.

However, a disadvantage of this type shoe is that the non-stretchable reinforcing member 104 may disturb the flexible movement of the sole of the foot and the wearer may not be adequately protected from shock when a load or impact is applied from below the arch.

SUMMARY OF THE INVENTION

Therefore, an object of the invention is to provide a wrestling shoe with outer soles that are separated and that has excellent fitting properties, support, and shock-absorbing properties in the arch of the foot.

To achieve the aforedescribed object, according to an aspect of the present invention, a wrestling shoe is provided that has outer soles separated forward and rearward on the side of a grounding surface of the shoe and comprises a fore outer sole (a forefoot outer sole) that contacts the ground in a fore foot part, a rear outer sole (a rearfoot outer sole) that contacts the ground in a rear foot part and an outer skin that covers a lower portion of a mid foot part between the fore foot part and the rear foot part. The fore and rear outer soles essentially protrude downward further than the outer skin, thereby to support a foot in the fore foot part (the toe) and the rear foot part (the heel), respectively, when landing on the ground. The fore and rear outer soles are made of an outer sole material of rubber and/or resin. The outer skin is formed of a laminated body where an outer surface layer and a cushion layer are laminated. The outer surface layer is exposed in the mid foot part and made of a substantially flexible sheet-like material. The cushion layer is laminated on the inner side of the outer surface layer and made of substantially flexible rubber foam or substantially flexible resin foam. The outer skin has a bottom portion and medial and lateral roll-up portions that roll up from the bottom portion along an upper. The bottom portion and the medial and lateral roll-up portions of the outer skin are integrally formed. The laminated body may, for example, be bent approximately in a shape of U in transverse cross section to form the bottom portion and the roll-up portions.

The outer surface layer may be made of a relatively smooth substantially flexible sheet-like material. In this case, the roll-up portions and bottom portions form a substantially smooth curvilinear outer surface over the mid foot part, the portion of the lateral side and the portion of the medial side. This minimizes the frictional coefficient between, for example the wrestling mat, and the bottom portion and lateral and medial side portions, permits the fore foot and rear foot of the soles to securely grip the wrestling mat, and provides complete flexibility of the foot between the fore foot and rear foot areas of the sole. In the preferred embodiment, the coefficient of friction between the smooth curvilinear surface and, for example the wrestling mat, is less than that between the fore foot and rear foot soles and the wrestling mat.

In the present invention, by the use of the term "outer sole" it is meant an exposed part of the shoe sole contacting the ground and its neighboring layer. The "outer sole" does not contact the sole of the foot. In addition, in the present invention, the term "outer sole" is not meant to include an inner sole butted along an upper in the shoe sole.

By the use of the term "outer sole material of rubber and/or resin" it is meant materials generally used for the grounding sole of the treading part, specifically, including materials having a JIS-A hardness (JISK5301) of about 35 to 90 degrees in the case of solid body and materials having a ASKER-C hardness of about 55 to 90 degrees in the case of foam. JIS-A hardness is a value obtained by measuring with a JIS-A type hardness meter in conformity with JISK6301. ASKER-C hardness is a value obtained by measuring with an ASKER-C type hardness meter.

According to the present invention, the laminated body of the outer skin is formed by laminating the outer surface layer which is substantially flexible and the cushion layer which is substantially flexible, and the laminated body itself after laminating is also substantially flexible. In the present invention, the term "substantially flexible" means a higher flexibility than that of at least either an inner sole or a sock lining. Accordingly, the laminated body has a higher flexibility than that of the inner sole, than that of the sock lining, or both that of the inner sole and that of the sock lining. The sock lining contacts the sole of the foot in the shoe.

The "sheet-like material" of the outer surface layer may include artificial leather, non-woven fabric, woven fabric, knitted cloth, cloth-like material and/or soft natural leather. Considering the abrasion resistance and the cost, artificial leather is preferable as the sheet-like material, and, for example, non-foaming polyurethane sheet having a high abrasion resistance can be employed.

The outer skin covers a part of the upper in the lower part of the upper, and in the case of the shoe having an inner sole, the outer skin covers a part of the upper and a part of the inner sole. Therefore, the outer skin is not in a direct contact with the sole of the foot.

It is preferred that, when there is substantially no-load on the shoe, the outer skin in the mid foot part does not substantially contact the ground, i.e., is recessed between the forefoot outer sole and rearfoot outer sole. By the use of the term "not substantially contact the ground", it is meant to include the case where the outer skin does not contact the ground surface or the floor at all, and also the case where the outer skin in the mid foot part merely touches or slightly contacts a wrestling surface (e.g., a surface of a wrestling mat).

According to the present invention, since the laminated body forming the outer skin of the mid foot part is substantially flexible, an excellent shoe fit can be obtained making it easier to perform the foot actions necessary for wrestling.

Further, the laminated body consisting of the sheet-like outer surface layer and the cushion layer of foam is bent so that the transverse cross section of the laminated body is formed in the U shape and the section modulus (modulus of section) of the laminated body is increased. Accordingly, the flexural rigidity of the laminated body is increased, i.e. the laminated body becomes harder to bend, thus enhancing the supporting capacity of the laminated body.

Furthermore, when load is applied to the mid foot part, for example, when a body or a foot of a wrestler touches the mid foot part, the cushion layer of foam absorbs the shock.

In a preferred embodiment of the present invention, the laminated body has an exposed portion where a surface of the outer surface layer is exposed in the mid foot part and an bonded portion where the surface of the outer surface layer is bonded to the top surface of the outer sole material in a rear end of the fore outer sole and a fore end of the rear outer sole, and the bonded portion is thinner than the exposed portion.

By forming the bonded portion thinner than the exposed portion, the exposed portion protrudes downward further than an edge of the bonding surface of the outer sole material for the fore and rear outer soles and the laminated body. This prevents the force of peeling the outer sole material off from the laminated body from arising at the edge, even if the outer soles touches strongly the wrestling surface.

In another preferred embodiment of the present invention, the foam of the cushion layer of the laminated body is squashed (flattened out) at the bonded portion thereby to form the bonded portion thinner as mentioned above. By such squashing the foam of the cushion layer of the laminated body at the bonding portion, the upper and the outer skin is never displaced with respect to the fore and rear outer soles at the position of the cushion layer, and so supporting function is improved.

In another preferred embodiment of the present invention, the shoe has an inner sole and Young's modulus of the foam of the cushion layer of the outer skin is set to be of smaller value than that of a material forming the inner sole. The inner sole is provided extending from the fore foot part to the rear foot part above the fore and rear outer soles and has the function of supporting the sole of the foot at the lower part inside the shoe. If the Young's modulus of the foam of the outer skin is larger than that of the material forming the inner sole, the foam of the outer skin is not substantially flexible.

ASKER-C hardness of the foam of the cushion layer of the outer skin is set to be preferably 45 degrees or less, more preferably 40 degrees or less. The reason why the physical property of the foam is represented by hardness, rather than the Young's modulus is that hardness is easier to be measured than the Young's modulus in foam. On the other hand, in order to enable comparison between the foam and the inner sole made of material other than foam, for example, non-woven fabric, paperboard and so on, in the case of comparing them, not hardness, but the Young's modulus is adopted.

BRIEF DESCRIPTION OF THE DRAWINGS

FIG. 3(*a*) is a sectional view taken along the line IIIa-IIIa of

FIG. 2, FIG. 3(*b*) is a sectional view taken along the line IIIb-IIIb of FIG. 2 and FIG. 3(*c*) is a sectional view taken along the line IIIc-IIIc of FIG. 2.

DESCRIPTION OF THE PREFERRED EMBODIMENTS

Figure 1:
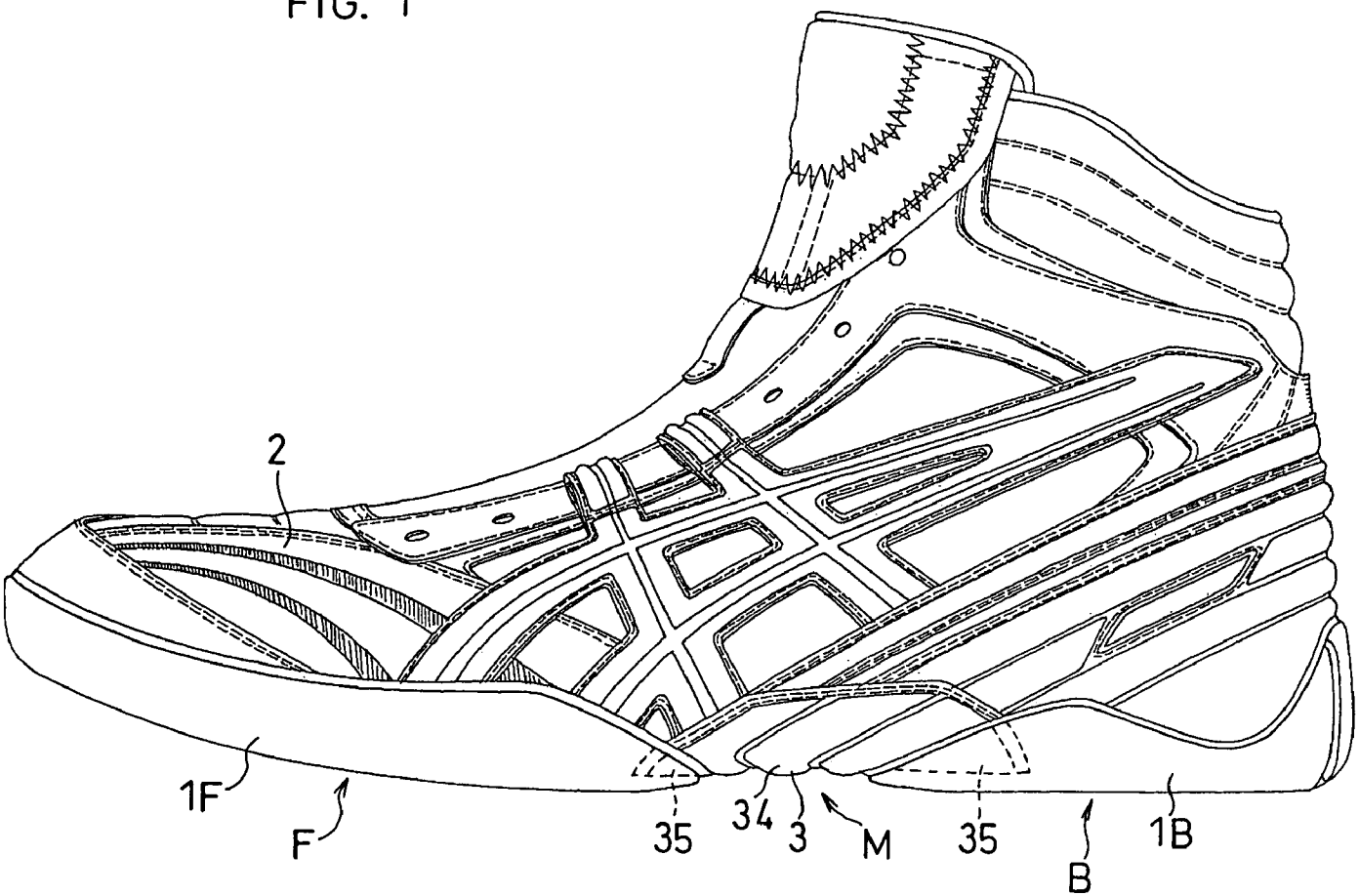
FIG. 1 is a side view of a shoe according to an embodiment of the present invention.

The present invention will be understood more apparently from the following description of the preferred embodiment when taken in conjunction with the accompanying drawings. However, it will be appreciated that the embodiments and the drawings are given for the purpose of mere illustration and explanation and that the scope of the present invention is to be defined by the appended claims. In the drawings annexed, the same reference numerals denote the same or corresponding parts throughout several views.

Hereinafter, an embodiment of the present invention will be described with reference to the drawings.

As shown in FIG. 1, the shoe has outer soles 1F, 1B separated forward and rearward on the side of a grounding surface of the shoe. That is, the shoe comprises a fore outer sole 1F that contacts the ground in a fore foot part F, a rear outer sole 1B that contacts the ground in a rear foot part B and an outer skin 3 that covers an inner sole 5 (FIG. 3(*a*)) and a lower portion of the upper 2 in a mid foot part M between the fore foot part F and the rear foot part B.

The fore outer sole 1F essentially protrudes downward further than the outer skin 3, thereby to support the foot in the fore foot part when landing on the ground. The rear outer sole 1B essentially protrudes downward further than the outer skin 3, thereby to support the foot in the rear foot part when landing on the ground. Under a no-load state (for example, when the shoe is not worn), the outer skin 3 does not essentially contact the ground.

Figure 2:
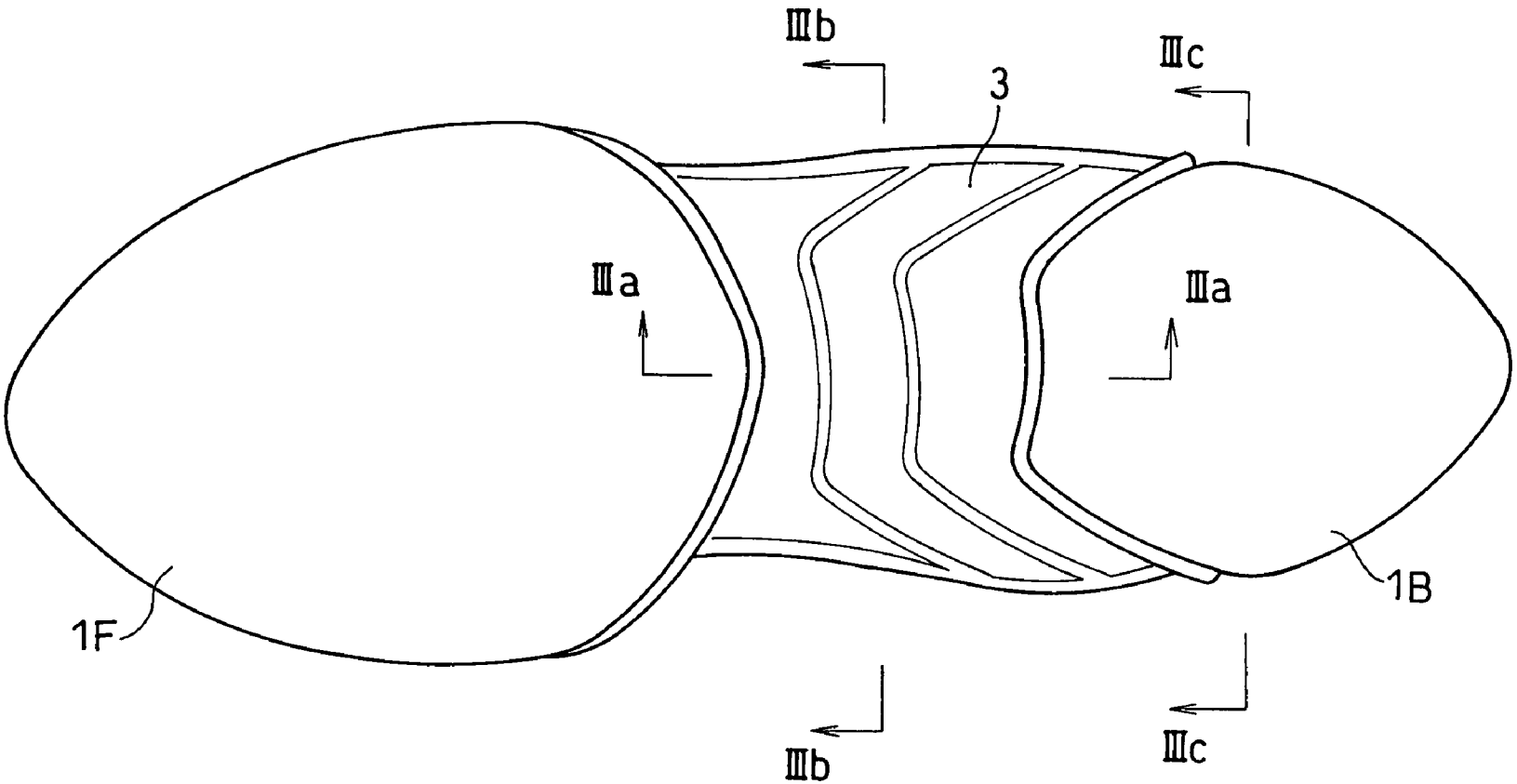
FIG. 2 is a bottom view of a sole of the shoe.
Figure 3A:
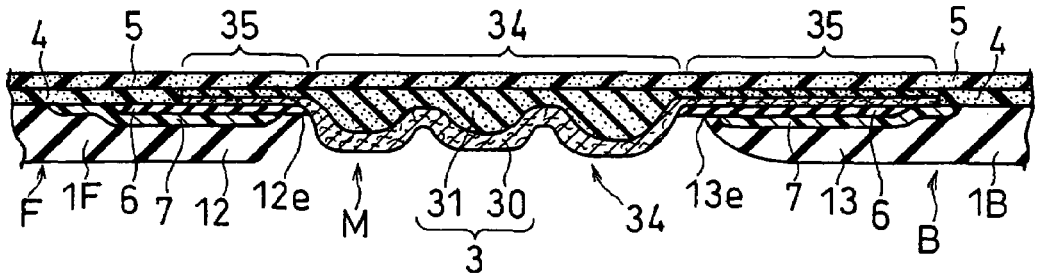
Figure 3B:
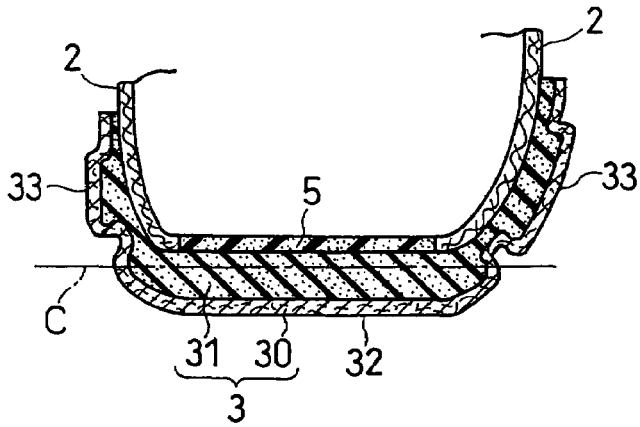
Figure 3C:
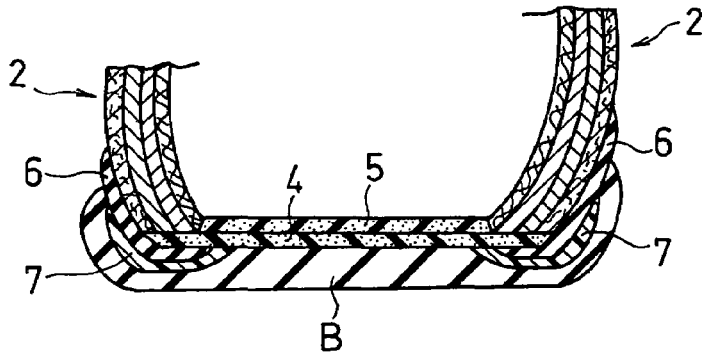
Figure 4A:
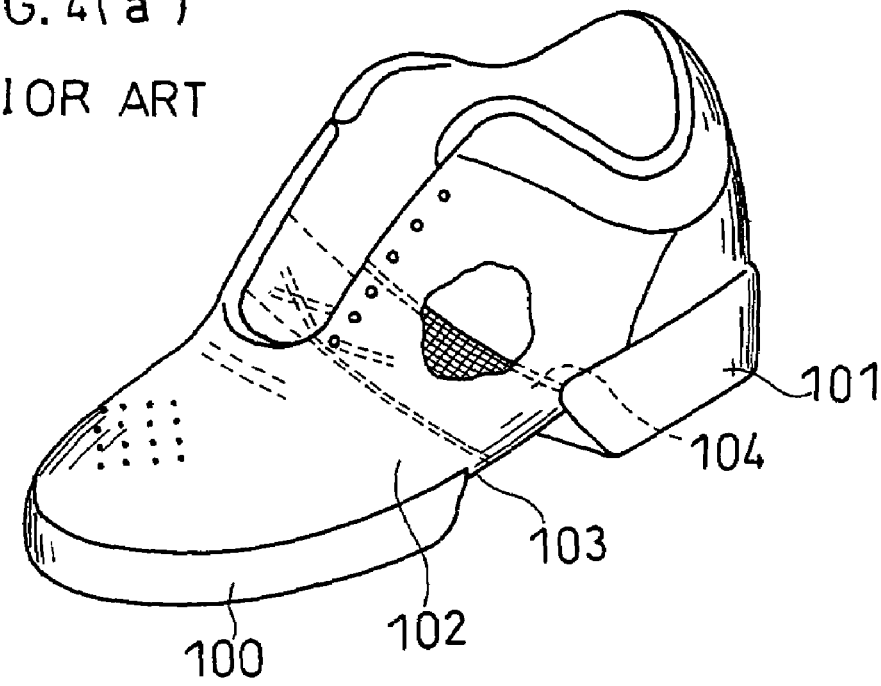
FIG. 4(a) PRIOR ART
FIG. 4(*a*) is a perspective view of a conventional (prior art) shoe and FIG. 4(*b*) is a bottom view thereof.
Figure 4B:
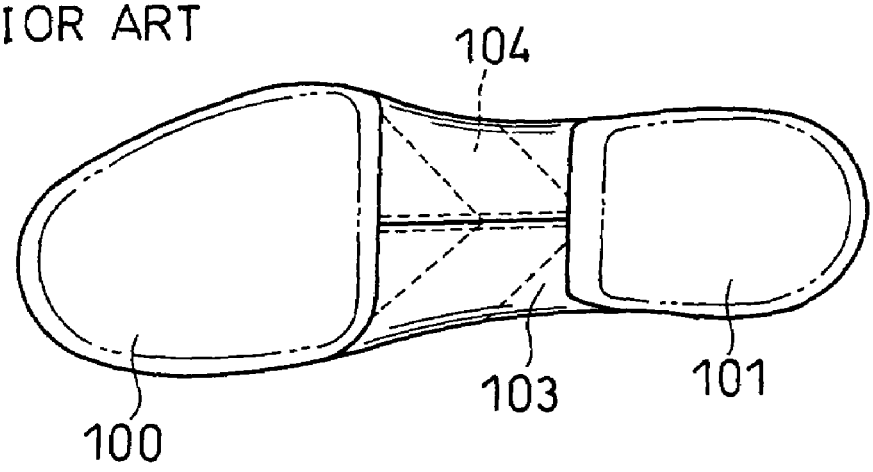
FIG. 4(b) PRIOR ART

FIG. 3(*a*) is a sectional view taken along the line IIIa-IIIa of FIG. 2, FIG. 3(*b*) is a sectional view taken along the line IIIb-IIIb of FIG. 2 and FIG. 3(*c*) is a sectional view taken along the line IIIc-IIIc of FIG. 2. Hereinafter, the structure of the shoe sole will be described with reference to these sectional views.

As shown in FIG. 3(*a*), in the fore foot part F, the fore outer sole 1F, a filler 4 and an inner sole 5 are laminated together in such order (from the bottom). In the rear foot part B, the rear outer sole 1B, the filler 4 and the inner sole 5 are laminated together such order (from the bottom). These components are made from materials which are conventionally used for shoe soles.

For example, the outer soles 1F, 1B are made of a solid body of rubber or a foam having a low expansion ratio. The filler 4 and the inner sole 5 are made of a foam of rubber.

The inner sole 5 and a sock lining (not shown) support substantially all of the sole of the foot within the shoe. As shown in FIG. 3(*b*) and FIG. 3(*c*), the inner sole 5 is abuts the lower end of the upper 2 and is bonded or attached to the upper 2. A filler 4, e.g., thin cushion, may be included in the shoe sole to cover the unevenness (roughness) that may exist in the shoe sole.

As shown in FIG. 3(*a*), in the mid foot part M, the outer skin 3 is laminated (stacked and adhesive bonded) below the inner sole 5.

The outer skin 3 is formed of a laminated body comprising an outer surface layer 30 and a cushion layer 31. The outer surface layer 30 is exposed in the mid foot part M. The outer surface layer 30 is made of substantially flexible sheet-like material such as artificial leather. The cushion layer 31 is laminated on an inner side of the outer surface layer 30. The cushion layer 31 is made of substantially flexible foam such as sponge rubber.

For example, the outer surface layer 30 may be an artificial leather formed by laminating a non-woven fabric layer of resin onto an inner side of a film layer of polyurethane, the opposite outer surface of which is the exposed surface. In this case, by enlarging the thickness of the film layer (solid body layer) the artificial leather can be a material which has excellent in wear-resistance.

Such a structure for a wrestling shoe may provide a coefficient of friction between the outer surface layer 30 and the wrestling surface (i.e., the wrestling mat) that is considerably lower than that between a surface of the material of the outer soles 1F, 1B and the wrestling surface.

As shown in FIG. 3(*b*), the outer skin 3 has a bottom portion 32 that covers the inner sole 5 and medial and lateral roll-up portions 33 that roll up from the bottom portion 32 along the upper 2. The bottom portion 32 and the medial and lateral roll-up portions 33 are integrally formed, i.e., a complete unit, whole. Preferably, the bottom portion 32 and the medial and lateral roll-up portions 33 are integrally formed from a continuous laminate. Both the outer layer 30 and the cushion layer are bent approximately in a shape of U in transverse cross section, i.e., the laminated body is bent approximately in a shape of U in transverse section, thereby to form the bottom portion 32 and the roll-up portions 33.

Thus, in the case where the above-mentioned integrally formed laminate comprising the thick cushion layer 31 of sponge rubber, the outer surface layer 30 and the inner sole 5 is bent at the time of exercise, the distance between a neutral axis C (a crossing line of a neutral surface where no displacement is generated at the time of bending deformation and a surface perpendicularly intersecting the neutral surface) of the laminate and the inner sole 5 increases, and the distance between the neutral axis C and the outer surface layer 30 also increases. Accordingly, the section modulus (modulus of section) of the laminate is increased. Further, a laminate of sponge rubber coated with a film-like or cloth-like material is much harder to bend than a single layer material of sponge rubber. Accordingly, the structure of the shoe sole of this embodiment increases the rigidity of the shoe sole consisting of the laminate against bending deformation, i.e. make the shoe sole harder to bend, to provide enhanced supporting capacity with the shoe sole. Even in this case, the shoe sole is still provided with an excellent fit and a soft touch, e.g., excellent cushioning, due to the cushioning layer 31.

As mentioned above, the bottom portion 32 and the roll-up portions 33 of the outer skin 3 include the cushion layer 31, and so, when a body of another wrestler or a foreign matter touches the lower portion of the medial side face or the lateral side face of the foot or the sole of the foot, the shock thereon can be suppressed, i.e., there is enhanced cushioning.

Preferably, the Young's modulus of the foam cushion layer 31 of the outer skin 3 is set smaller than that of a material forming filler 4 (FIG. 3(*a*)) and the inner sole 5. Thus, the material of the cushion layer 31 of the outer skin 3 is easier to compress than that of the filler 4 and the inner sole 5. Since the outer skin 3 is made of such compressible foam, the joint between the mid foot part M and the fore foot part F and the joint between the mid foot part M and the rear foot part B are realized, i.e., not inhibited from performing their natural function, as described below.

Still referring to FIG. 3(*a*), for example, the laminated body of the outer skin 3 is exposed in the mid foot part M to form an exposed portion 34. The laminated body of the outer skin 3 has a bonded portion 35 in a rear end 12 of the fore outer sole 1F and a fore end 13 of the rear outer sole 1B. At these bonded portions 35, the surface of the outer surface layer 30 is bonded to the top surface of the outer sole material. The cushion layer 31 and a non-woven fabric layer of the outer surface layer 30 are squeezed together to form bonded portions 35 that are substantially thinner than the exposed, non-bonded portion 34. This squeezing together of the laminate causes the density of the foam at the bonded portions 35 to be greater than that of foam of at the exposed portion 34.

Still referring to FIG. 3(*a*), since the bonded portions 35 are thinner than the exposed portion 34, a rear edge 12*e* of the fore outer sole 1F and a fore edge 13*e* of the rear outer sole 1B are recessed from the surface of the outer skin 3 in the mid foot part M. Thus these edges 12*e*, 13*e* are recessed from the grounding surface of the outer soles 1F, 1B and even further recessed from the surface of the outer skin 3 in the mid foot part M. Accordingly, foreign matter such as a wrestling mat and a body of another wrestler are unlikely to contact the edges 12*e*, 13*e*, thus minimizing or preventing the outer soles 1F, 1B from peeling off at the edges 12*e*, 13*e*. Further, it becomes difficult to apply an external force to the edges 12*e*, 13*e*.

On the boundary surface between the outer skin 3 and the fore outer sole 1F or the rear outer sole 1B, a tape of resin or rubber may be provided so as to improve the adhesiveness between the outer skin 3 and the outer soles 1F, 1B.

Next, the way how to fix the outer soles 1F, 1B to the upper 2 will be briefly explained.

The outer soles 1F, 1B are fixed to the upper 2 by so-called vulcanizing manufacture. That is, unvulcanized or semi-vulcanized outer soles 1F, 1B are formed, and the upper 2 and the inner sole 5, assembled integrally, are fitted on the shoe last. In such state, coating an adhesive on the unvulcanized or semi-vulcanized outer soles 1F, 1B and the upper 2, and then the outer soles 1F, 1B and the upper 2 are pressed on each other to be bonded adhesive. At this time, since the bonded portion 35 of the outer skin 3 is compressed, the outer surface layer 30 and the cushion layer 31 is formed thin at the bonded portion 35.

Thus, since the bonded portion 35 of the outer skin 3 is compressed in advance when manufacturing the shoe, the outer soles 1F, 1B are prevented from peeling off. That is, this shoe is excellent in productivity.

Other embodiments are also contemplated within the scope of this invention. For example, the upper may be formed in an annular shape in transverse cross section, without providing the inner sole. A midsole may be provided on the outer sole. Such midsole may be provided only in the fore foot part and the rear foot part on the outer sole, or may be provided so as to cover approximately full length of the foot.

As described above, although the preferred embodiments have been described with reference to the drawings, one of ordinary skill in the art could conceive various modifications and corrections within an obvious range by referring to the present specification.

Accordingly, all such modifications are intended to be included within the scope of the invention.

What is claimed is:

1. A wrestling shoe with outer soles separated forward and rearward on a side of a grounding surface of the shoe comprising:

a fore outer sole that contacts a ground in a fore foot part;

a rear outer sole that contacts the ground in a rear foot part; and an outer skin that covers a lower portion of a mid foot part between the fore foot part and the rear foot part, wherein the fore and rear outer soles essentially protrude downward further than the outer skin, thereby to support a foot in the fore foot part and the rear foot part, respectively, when landing on the ground, the fore and rear outer soles are made of an outer sole material of rubber and/or resin, the outer skin is formed of a laminated body where an outer surface layer and a cushion layer are laminated, the outer surface layer is exposed in the mid foot part and made of substantially flexible sheet-like material, the cushion layer is laminated on an inner side of the outer surface layer and made of substantially flexible rubber foam or substantially flexible resin foam, the outer skin has a bottom portion and medial and lateral roll-up portions that roll up from the bottom portion along an upper, the bottom portion and the medial and lateral roll-up portions of the outer skin are integrally formed, and the laminated body is bent approximately in a shape of U in transverse cross section to form the bottom portion and roll portions, an inner sole placed extending from the fore foot part to the rear foot part above the fore and rear outer soles, wherein the bottom portion of the outer skin covers the inner sole, wherein the laminated body has an exposed portion wherein a surface of the outer surface layer is exposed in the mid foot part and a bonded portion wherein the surface of the outer surface layer is bonded to a top surface of the outer sole material in a rear end of the fore outer sole and a fore end of the rear outer sole, and the bonded portion is thinner than the exposed portion.

2. A wrestling shoe with outer soles separated according to claim 1, wherein in a no-load state, the outer skin does not essentially contact the ground.

3. A wrestling shoe with outer soles separated according to claim 1, wherein the cushion layer at the bonded portion is squeezed between the inner sole and the outer soles so as to form the thinner bonded portion.

4. A wrestling shoe with outer soles separated according to claim 1, wherein Young's modulus of the foam of the cushion layer of the outer skin is set to be smaller than that of a material forming the inner sole.

5. A wrestling shoe with outer soles separated according to claim 1, wherein the outer surface layer is made of a wear-resistant material.

* * * * *